US005268218A

United States Patent [19]

Zafiroglu

[11] Patent Number: 5,268,218

[45] Date of Patent: Dec. 7, 1993

[54] RESIN-IMPREGNATED PLEXIFILAMENTARY SHEET

[75] Inventor: Dimitri P. Zafiroglu, Wilmington, Del.

[73] Assignee: E. I. Du Pont de Nemours and Company, Wilmington, Del.

[21] Appl. No.: 23,663

[22] Filed: Feb. 26, 1993

[51] Int. Cl.[5] ..... D04H 1/48; D04H 13/02

[52] U.S. Cl. ..... 428/219; 427/299; 428/220; 428/290

[58] Field of Search ..... 427/299; 428/219, 220, 428/290

[56] References Cited

U.S. PATENT DOCUMENTS

| | | | |
|---|---|---|---|
| 3,169,899 | 2/1965 | Steuber | 428/198 |
| 3,403,862 | 10/1968 | Dworjanganyn | 239/566 |
| 3,485,706 | 12/1969 | Evans | 428/134 |
| 3,532,589 | 10/1970 | David | 428/156 |
| 4,152,389 | 5/1979 | Miller | 264/284 |
| 5,023,130 | 6/1991 | Simpson et al. | 428/227 |

OTHER PUBLICATIONS

"Tyvek Softening Process" Research Disclosure, No. 21126, p. 403 (Nov. 1981).

*Primary Examiner*—James C. Cannon

[57] ABSTRACT

Sheets of flash-spun polyolefin plexifilamentary film-fibril strands are subjected to impact-energy by columnar jets of water and are then impregnated with organic resin to provide sheet of high abrasion resistance and a wide range of desirable porosity.

5 Claims, No Drawings

RESIN-IMPREGNATED PLEXIFILAMENTARY SHEET

BACKGROUND OF THE INVENTION

1. Field of the invention

The present invention relates to nonwoven sheets of flash-spun polyolefin plexifilamentary film-fibril strands. More particularly, the invention concerns a process for impregnating such sheets with resin and novel resin-impregnated sheets made thereby.

2. Description of the Prior Art

Nonwoven sheets of flash-spun polyolefin plexifilamentary film-fibril strands of very high surface area per unit weight are known. Several varieties of such sheets are known. For example, Steuber, U.S. Pat. No. 3,169,899, discloses lightly consolidated nonbonded sheets of this type. David, U.S. Pat. No. 3,532,589, discloses subjecting the entire surface of sheets of Steuber to thermal self-bonding. Miller, U.S. Pat. No. 4,152,389, discloses point-bonding sheets of Steuber. Such sheet varieties are made by E. I. du Pont de Nemours & Co. of Wilmington, Del., and sold as Tyvek® spunbonded olefin.

It is also known to subject nonwoven sheets of lightly consolidated flash-spun polyolefin plexifilamentary film-fibril strands to treatment with with columnar jets of water supplied. For example, Evans, U.S. Pat. No. 3,485,706, Example 57, discloses subjecting a sheet that was consolidated between pressure rolls to high-energy streams of water issuing from a plurality of orifices while the sheet was supported on an apertured plate (having 0.048-inch diameter holes in staggered array on 0.08-inch centers) and the orifices were supplied with water at pressures between 1500 and 2000 psi. Softening of point-bonded sheets of Miller by treating them with jets of water supplied at a pressure of 140 to 2130 psi through orifices of 0.004 to 0.016 inch diameter is disclosed in "Tyvek® Softening Process", Research Disclosure, no. 21126, p. 403 (Nov. 1981). Further, Simpson et al, U.S. Pat. No. 5,023,130, disclose that nonbonded sheets of Steuber can be hydroentangled while supported on a screen by treatment with columnar jets of water supplied at a pressure of at least 2000 psi and then to treat the sheet further with finer jets of water supplied at a pressure of 300 to 1200 psi to redistribute the fibers. The latter type jet-treated sheet also is sold by E. I. du Pont de Nemours & Co. as Typro®. In each of the hydraulic jet treatments described above, jets of the type disclosed by Dworjanyn, U.S. Pat. No. 3,403,862, are particularly suitable.

The known sheets of flash-spun polyolefin in plexifilamentary film-fibril strands have proven useful in many applications. However, their utility could be enhanced considerably if they could be impregnated satisfactorily with resins. Accordingly, an aim of this invention is to provide a resin-impregnated nonwoven sheet of flash-spun polyolefin plexifilamentary film-fibril strands and a process for preparing such sheets. Such resin-impregnated sheets would be useful for athletic shoe reinforcing strips, breathable leather-replacement goods, abrasion resistant surface layers for briefcases, luggage and the like.

SUMMARY OF THE INVENTION

The present invention provides a resin-impregnated nonwoven sheet comprising a nonwoven layer of flash-spun polyolefin plexifilamentary film-fibril strands impregnated with a synthetic organic resin, the nonwoven layer being in the range of 10 to 70% of the total weight of the resin-impregnated sheet and the resin being in the range of 90 to 30% of the total weight, the total weight of the resin-impregnated sheet being in the range of 50 to 500 grams per square meter. Preferably, the resin-impregnated nonwoven sheet weighs in the range of 100 to 300 g/m$^2$, and has a thickness in the range of 0.15 to 0.50 mm. The resin-impregnated sheet has a water-vapor permeability that can vary from substantially impermeable to as high as 1500 grams/day/m$^2$; preferred sheets have a water-vapor permeability in the range of 500 to 1000 g/day/m$^2$.

The present invention also provides a method for making the resin-impregnated nonwoven sheet. The process comprises preparing a lightly consolidated nonwoven sheet of strands, the sheet weighing in the range of 25 to 150 g/m$^2$, supporting the nonwoven sheet on a foraminous member, advancing the supported sheet underneath columnar jets of water which are supplied to orifices of 0.07 to 0.25 mm in diameter at a pressure in the range of 1380 to 20,700 KPa (200 to 3000 psi) and provide a total impact energy of at least 0.02 megaJoule-Newtons per kilogram, preferably in the range of 0.04 to 0.16 MJ-N/Kg to open the sheet structure, impregnating the sheet with a solution of resin in a solvent which is a non-solvent for the polyolefin, the resin amounting to 30 to 90 percent of the total weight of the dry resin-impregnated sheet evaporating the solvent from the impregnated sheet.

DETAILED DESCRIPTION OF PREFERRED EMBODIMENTS

The starting material for the resin-impregnated nonwoven sheet of the invention is a lightly consolidated sheet of polyolefin plexifilamentary film-fibril strands, produced by the general procedure of Steuber, U.S. Pat. No. 3,169,899. According to a preferred method of making the starting sheets, linear polyethylene having a density of at least 0.96 g/cm$^3$, a melt index of 0.9 (determined in accordance with ASTM method D 1238-57T, condition E) and a 135° C. upper limit of its melting temperature range, is flash spun from a 12 weight percent solution of the polyethylene in trichlorofluormethane. The solution is pumped continuously to spinneret assemblies at a temperature of about i79° C. and a pressure of about 85 atmospheres. The solution is flash-spun from orifices in the spinneret assemblies into zone of one atmosphere pressure. The flash-spinning results in plexifilamentary film-fibril strands which are then spread, oscillated and electrostatically charged as the strands are forwarded to a moving belt on which they form overlapping deposits that constitute a wide batt. The batt is then lightly consolidated by passage through a nip formed between two metal rolls. The nip applies a load of about 1.8 Kg per cm width of batt. The resultant lightly consolidated batt (or sheet), for use in the present invention, typically has a unit weight in the range of 35 to 150 g/m$^2$. Without further treatment, the lightly consolidated sheet cannot be impregnated satisfactorily with resin. The sheet has a resistance that is too high for penetration by liquids by convenient means at ordinary pressures. For example, dipping the lightly consolidated sheet into a liquid usually may wet the surface somewhat, but does not result in thorough penetration of the fibrous sheet by the liquid.

To render the lightly consolidated sheet of flash-spun polyethylene film-fibril strands more suitable for resin-impregnation by conventional techniques, in accordance with the invention, the sheet is subjected to columnar jets of water that impart to the sheet an impact energy (i.e., referred to herein as "IxE") of at least 0.02 MegaJoule-Newtons per Kilogram, preferably in the range of 0.04 to 0.16 MJN/Kg. Equipment of the general type disclosed by Evans, U.S. Pat. No. 3,485,706, and by Dworjanyn, U.S. Pat. No. 3,403,602, is suitable for the water jet treatment. In addition to rendering lightly consolidated sheet suitable for resin-impregnation, the treatment also can render point-bonded sheet of the general type disclosed by Miller, U.S. Pat. No. 4,152,389, suitable for resin-impregnation by conventional techniques. However, such hydraulic jet treatment does not render area-bonded sheets, of the general type disclosed by David, U.S. Pat. No. 3,442,740, suitable for resin impregnation.

The energy-impact product delivered by the water jets impinging upon the lightly consolidated or point-bonded sheet is calculated in the known manner by the following equations, in which all parameters are listed in "English" units from measurements originally made or from units converted from measurements originally made (e.g., pounds per square inch converted to pounds per square foot) so that the IxE product is in foot-pounds pounds (force) per pound(mass). The expression can then be divided by $1.98\times10^6$ foot-pounds(force) per horsepower-hour pounds(force) to then obtain an IxE product in horsepower-hours pounds(force) per pound-(mass), which when multiplied by 26.3 is converted to megaJoules-Newtons per kilogram (MJN/Kg).

$$I=PA$$

$$E=PQ/wzs$$

wherein

I is impact in pounds(force),

E is jet energy in foot-pounds(force) per pound-(mass),

P is water pressure immediately upstream of the orifice in pounds per square foot, A is the cross-sectional area of the jet in square feet, Q is volumetric flow of water in cubic feet per minute, w is sheet unit weight in pounds mass per square yard, z is sheet width in yards, and s is the sheet speed in yards per minute.

Note that in accordance with the invention, the energy-impact product must be at least 0.02 MJN/Kg to make the lightly consolidated or point-bonded starting sheet of flash-spun polyolefin plexifilamentary film-fibril strands suitable for resin impregnation. Impact-energy products as high as 1.5 MJN/Kg can be employed, but for reasons of economy, lower IxE values in the range of 0.04 to 0.16 MJ-N/Kg are preferred. It is believed that such impact-energy products opens the sheet structure sufficiently to allow the subsequently applied resin solution to enter the sheet and envelop the film-fibril strands. Without such treatment, the sheet acts as a barrier to the subsequently applied resin solution and the resin dries as a coating or as a non-uniform impregnant rather than as a uniform impregnant of the sheet.

During the hydraulic treatment, the sheet can be supported on various types of foraminous members, such as a screen or a foraminous roll. If the foraminous member screen is a fine, high-mesh screen, a flat non-patterned sheet is produced. Patterned foraminous supports can impart patterns to the sheet. A support member that is a coarse screen allows the production of perforated sheets.

The desired impact energy can be imparted to the sheet by operating the water-jet treatment under the following typical conditions. The sheet can be treated on one or both surfaces. Treatment on only one side is preferred. Suitable treatment includes use of closely spaced jets of water supplied from small diameter orifices. The orifices can be located 2 to 5 cm above the sheet being treated and arranged in rows perpendicular to the movement of the sheet. Each row can contain 4 to 40 orifices per centimeter. Orifice diameters in the range of 0.07 to 0.25 mm are suitable; 0.12 to 0.18-mm diameters are preferred. The orifices can be supplied with water at a pressure in the range of 2000 to 20,000 KPa.

Resin can be applied to the jet-treated sheet by conventional means. Most conveniently, the resin is applied by immersing the sheet in an aqueous solution of the resin or in a solution of the resin in an organic solvent. For example, the sheet can be impregnated satisfactorily by passing the sheet through a bath of a solution of the resin. A residence time of as short as ½ minute in the bath can be sufficient. After immersion in the bath, the sheet is removed from the bath and excess solution is allowed to drain from the sheet. Then, the solvent is evaporated from the sheet to provide a resin-impregnated sheet. The dry weight of resin applied to the sheet can be controlled by the time in the bath, the concentration of resin in the solution and the number of passes the sheet makes through the bath. Other conventional means of resin application are also suitable, such as pressing of a resin paste into the sheet, spraying, and the like.

In accordance with the invention, the weight of the polyolefin plexifilamentary film-fibril strand layer amounts to in the range of 10 to 70% and the dry resin amounts to in the range of 90 to 30 % of the total weight of the dry resin-impregnated sheet. By controlling the concentration of resin in the sheet and the total weight of the sheet, sheets can be made with a wide range of permeabilities. The time of exposure to resin solution is controlled to assure complete penetration of the sheet with resin. Complete penetration of the sheet with a suitable amount of resin solution assures that when the solvent is removed, a stong, uniformly resin-impregnated sheet of high surface-abrasion resistance is obtained. Excessive amounts of resin result in a surface of the resultant sheet that is free of fiber. A layer of resin coating without fibers therein results in a surface of relatively low abrasion resistance, in comparison to a surface layer that contains resin-impregnated fiber.

TEST METHODS

Several parameters and characteristics of the sheets of the invention were mentioned in the preceding text and are reported in the examples below. These parameters and characteristics are measured by the following methods, in which "ASTM" means American Society for Testing and Materials and "TAPPI" means The Technical Association of the Pulp and Paper Industry.

The unit weight of a fabric or fibrous layer is measured according to ASTM Method D 3776-79.

Thickness is measured according to the general procedures of ASTM D 1777. A digital "touch" micrometer (e.g., a model APB-lD, manufactured by Mitutoyo of Japan) is employed. The micrometer applies a 10-gram load to the surface of the fabric through a ¼-inch (0.64-cm) diameter flat cylindrical probe.

To determine the abrasion resistance of samples a Wyzenbeek "Precision Wear Test Meter", manufactured by J. K. Technologies Inc. of Kankakee, Illinois, is employed with an 80-grit emery cloth wrapped around the oscillating drum of the tester. The drum is oscillated back and forth across the face of the sample at 90 cycles per minute under a load of six pounds (2.7 kg). The test is conducted in accordance with the general procedures of ASTM D 4157-82. The thickness of the sample is measured with the aforementioned micrometer before and after a given number of abrasion cycles to determine the wear in millimeters of thickness lost per 1,000 cycles.

Water-vapor permeability of a fabric sample is measured in grams per day per square meter (g/day/m$^2$) in accordance with the general method of TAPPI T 448 su-71, "Water Vapor Permeability of Paper and Paperboard".

EXAMPLES

The following Examples illustrate the invention. Samples made in accordance with the invention are compared to samples that are outside the scope of the invention. The examples illustrate how the abrasion resistance and porosity of resin-impregnated samples of flash-spun polyethylene plexifilamentary film-fibril strand sheets are affected by the hydraulic jet treatment and by the amount of resin impregnated into the sheet.

In the Examples, all percentages, unless stated otherwise, are based on the total weight of the resin-impregnated sheet. A summary table of data accompanies each example and records the unit weight, composition, thickness, water-vapor permeability and abrasion resistance of each sample. Samples of the invention are designated with Arabic numerals; comparison samples, with upper case letters. The reported results are believed to be fully representative of the invention, but do not constitute all the tests involving the indicated fibrous layers and resins.

In the examples, various sheets of flash-spun polyethylene plexifilamentary film-fibril strands are employed. Such sheets, indicated as Tyvek® or Typro®, are available commercially from E. I. du Pont de Nemours & Co. Specifically, the following sheet samples are used:

W-1. Typro® a commercial sheet made from lightly consolidated 1.3-oz/yd$^2$ (44-g/m$^2$) Type 800 Tyvek® sheet that was subjected to a total impact-energy product of about 1.8 MJ-N/Kg by passage through columnar jets of water while supported on a screen. Such sheets are made in accordance with general procedures described by Simpson et al, U.S. Pat. No. 5,023,130.

W-2. Lightly consolidated, 1.3-oz/yd$^2$ (44-g/m$^2$) Type 800 Tyvek® spunbonded olefin sheet that was subjected to a total impact-energy product of about 0.03 MJ-N/Kg by passage two times at 10 yards/min (9.14 m/min) under a row of columnar jets of water, spaced 40/inch (15.7/cm), positioned perpendicular to the direction of movement of the sheet, and emerging from orifices of 0.005-inch (0.127-mm) diameter supplied with water at 500 psi (3,445 KPa) located about 1 inch (2.5 cm) above the sheet.

W-3. Point-bonded Type 16 Tyvek® spunbonded olefin sheet that was subjected to the identical 0.03 MJ-N/Kg treatment as was W-2.

W-4. Lightly consolidated, 1.3-oz/yd$^2$ (44-g/m$^2$) Type 800 Tyvek® spunbonded olefin sheet that was subjected to no hydraulic jet treatment.

W-5. Point-bonded Type 16 Tyvek® spunbonded olefin sheet that was subjected to no hydraulic jet treatment.

W-6 Lightly consolidated Type 800 Tyvek® sheet of 1.3 to 1.4 oz/yd$^2$ (44 to 47g/m$^2$) that was subjected to a total impact-energy product of 0.47 MJ-N/Kg while being advanced, in three passes, at 10 yards per minute (9.1 m/min) under columnar streams of water which emerged from a row of 0.5-inch (0.127-mm) diameter orifices, the row of orifices being located about 1 inch (2.5 cm) sheet and extending transverse of length of the moving assembly, with the orifices being spaced within the row at 40 per inch (57/cm) and being supplied with water at a pressure of 200 psi (1380 KPa) in the first pass, 1000 psi (6890 KPa) in the second pass and 2000 psi (13,800 KPa) in the third pass, to form an apertured sheet.

Sheets W-1, W-2, W-3 and W-6 were subjected to the indicated hydraulic jet treatment while being supported on a 24-mesh screen having an open area of about 20%. Sheets W-1, W-2, W-3, W-4 and W-5 are used in Examples 1 and 2. Sheet W-6 is used in Example 3.

In the examples, each sheet sample was dipped in a polyurethane resin solution in an attempt to impregnate each sample with resin. The polyurethane resin solution was either (a) an aqueous solution (i.e., "ZIP-Guard" clear gloss wood finish, manufactured and sold by Star Bronze Co., Alliance, Ohio) or (b) a solution in an organic solvent (i.e., "ZAR" clear polyurethane finish, manufactured and sold by United Gilsonite Laboratories of Scranton, Pa.). After dipping the sheet sample into the resin solution, excess solution was allowed to drip from the sample, and then the sample was in air for 48 hours at 25° C. and 40% relative humidity. Each of the samples was then tested for water-vapor permeability and abrasion resistance.

EXAMPLE 1

In this example, sheets of flash-spun polyethylene plexifilamentary film-fibril strands which were subjected to hydraulic jet impact-energy and resin-impregnated in accordance with the invention are compared to substantially identical sheets that were subjected to the same resin impregnation procedure but were not exposed to a hydraulic jet treatment. The resin used in the resin- impregnation treatment was "ZIP", the aqueous solution of polyurethane described above. Samples A and B, which were not subjected to a hydraulic jet treatment and are outside the invention, could not be satisfactorily impregnated. In contrast, Samples 1, 2 and 3, which were subjected to a total energy-impact product (IXE) of 1.8, 0.3 and 0.03 MJ-N/Kg, respectively, could be uniformly impregnated with the resin and formed products of the invention. Table I, below, summarizes details of the sample characteristics and properties. Note that as a result of the appropriate hydraulic jet treatment, Samples 1, 2 and 3 of the invention were as little as 37 times, and as much as to 130 times, as abrasion resistant as the comparison samples.

TABLE I

| Sample | 1 | 2 | A | 3 | B |
|---|---|---|---|---|---|
| Starting sheet | W-1 | W-2 | W-4 | W-3 | W-5 |
| IxE, MJ-N/Kg | 1.8 | 0.03 | 0 | 0.03 | 0 |
| Weight, g/m$^2$ | 109 | 234 | 98 | 153 | 109 |
| % Fiber | 41 | 19 | 45 | 29 | 41 |
| % Resin | 59 | 81 | 55 | 71 | 59 |
| Thickness, mm | 0.18 | 0.38 | 0.23 | 0.30 | 0.15 |
| Permeability, g/d/m$^2$ | 32 | 58 | 44 | 45 | 19 |
| Wear, mm/1000 cycles | 0.025 | 0.023 | 3.0 | 0.040 | 1.5 |
| Relative wear* | 1.09 | 1.0 | 130 | 1.74 | 65 |

Notes: *relative to sample 2

EXAMPLE 2

Example 1 was repeated, except that "ZAR", a polyurethane resin in organic solvent was used as the resin. Table II summarizes details of the test results.

TABLE II

| Sample | 4 | 5 | C | 6 | D |
|---|---|---|---|---|---|
| Starting sheet | W-1 | W-2 | W-4 | W-3 | W-5 |
| IxE, MJ-N/Kg | 1.8 | 0.03 | 0 | 0.03 | 0 |
| Weight, g/m$^2$ | 142 | 393 | 170 | 247 | 139 |
| % Fiber | 31 | 11 | 26 | 18 | 32 |
| % Resin | 69 | 89 | 74 | 82 | 68 |
| Thickness, mm | 0.25 | 0.53 | 0.25 | 0.40 | 0.25 |
| Permeability, g/d/m$^2$ | 6 | 20 | 9 | 19 | 19 |
| Wear, mm/1000 cycles | 0.076 | 0.076 | 0.84 | 0.18 | 2.29 |
| Relative wear* | 1.0 | 1.0 | 11 | 2.3 | 30 |

Notes: *relative to sample 5

As shown by Table II above, the resin-impregnated, hydraulic-jet treated, flash-spun polyethylene plexifilamentary film-fibril strand sheets of the invention were, as in Example 1, much more abrasion resistant than the comparison samples which received no hydraulic jet treatment. Samples of the invention were about 5 to 30 times as abrasion resistant an the comparison samples.

EXAMPLE 3

In this example, an apertured sheet of hydraulic-jet-treated, flash-spun polyethylene plexifilamentary film-fibril strand sheet (Sheet W-6, described above) is impregnated by the procedures of Examples 1 and 2 with aqueous and organic solutions of polyurethane resin, to provide samples of differing resin content. Results are summarized in Table III below.

TABLE III

| Sample | E | 7 | 8 | F | 9 | 10 |
|---|---|---|---|---|---|---|
| Resin | ZAR | ZAR | ZAR | ZIP | ZIP | ZIP |
| % dilution+ | 25 | 50 | 100 | 25 | 50 | 100 |
| Weight, g/m$^2$ | 48 | 75 | 139 | 54 | 64 | 142 |
| % Fiber | 92 | 64 | 32 | 88 | 69 | 31 |
| % Resin | 8 | 36 | 68 | 12 | 31 | 69 |
| Thickness, mm | 0.33 | 0.36 | 0.41 | 0.38 | 0.41 | 0.43 |
| Permeability, g/day/m$^2$ | 1010 | 1032 | 950 | 1020 | 920 | 1090 |
| Wear, mm/1000 cycles | 0.51 | 0.10 | 0.066 | 0.30 | 0.058 | 0.025 |
| Relative wear | 7.7+ | 1.5+ | 1.0+ | 12x | 2.3x | 1.0x |

Notes:
+% of original polyurethane resin solution.
*Relative to sample 8.
xrelative to sample 10.

Note that comparison Samples E and F, which contained only 8% and 12% resin, respectively, each had inadequate abrasion resistance. Note also the advantageous combination of very high water-vapor permeability (of about 1000 g/d/m$^2$) and high abrasion resistance (about 0.03 to 0.1 mm/1000 cycles) possessed by the samples of the invention. In contrast, leather of the type intended for shoe uppers, has a water vapor permeability of about 500 grams/day/m$^2$ and an abrasion resistance of only about 0.4 to 1.3 mm/1000 cycles. Furthermore, the samples of the invention were able to survive ten laundering cycles in a home washer. In contrast, leather samples were substantially degraded by only one such wash cycle.

Although the invention was illustrated with sheets of flash-spun polyethylene film-fibril strands that were impregnated with polyurethane, other flash-spun polyolefins (e.g., polypropylene and the like) and solutions of other resins (e.g., polyester, natural or synthetic rubber, and the like) also can be used to produce abrasion-resistant, resin-impregnated sheets in accordance with the invention.

The sheets of the invention are suitable for use in flat or molded form in shoe uppers, luggage, pocketing, wear-resistant patches, protective clothing and the like.

What is claimed is:

1. A resin-impregnated nonwoven sheet comprising a nonwoven layer of flash-spun polyolefin plexifilamentary film-fibril strands which has been water jet impacted and impregnated with an organic resin, the nonwoven layer being in the range of 10 to 70% of the total weight of the resin-impregnated sheet and the resin being in the range of 90 to 30% of the total weight of the resin-impregnated sheet, the total weight of the resin-impregnated sheet being in the range of 50 to 500 grams per square meter.

2. A resin-impregnated nonwoven sheet in accordance with claim 1 wherein resin-impregnated sheet has a total weight in the range of 60 to 200 g/m$^2$, a thickness in the range of 0.15 to 0.50 mm, a water-vapor permeability in the range of 10 to 1500 grams per day per square meter, and a Wyzenbeek abrasion wear is of no more than 0.2 mm/1000 cycles.

3. A resin-impregnated nonwoven sheet in accordance with claim 2 wherein the permeability is in the range of 500 to 1200 g/d/m$^2$ and the abrasion wear is no more than 0.1 mm/1000 cycles.

4. A process for preparing a resin-impregnated nonwoven sheet of flash-spun polyolefin plexifilamentary film-fibril strands comprising preparing a lightly consolidated nonwoven sheet of flash-spun polyolefin plexifilamentary film-fibril strands, the sheet weighing in the range of 25 to 150 g/m$^2$, supporting the nonwoven sheet on a foraminous member, advancing the supported sheet underneath columnar jets of water, said jets being supplied to orifices at a pressure in the range of 1,380 to 20,700 KPa and providing a total impact energy of at least 0.02 megaJoule-Newtons per kilogram to open the sheet structure, impregnating the sheet with a solution of resin in a solvent which is a non-solvent for the polyolefin, the resin amounting to 30 to 90 percent of the total weight of the dry resin-impregnated sheet evaporating the solvent from the impregnated sheet.

5. A process in accordance with claim 4 wherein the impact energy product is in the range of 0.04 to 0.16 MJN/Kg.

* * * * *